US007093769B2

(12) United States Patent
Toiyama

(10) Patent No.: US 7,093,769 B2
(45) Date of Patent: Aug. 22, 2006

(54) DYNAMIC FLOW RATE ADJUSTING METHOD FOR INJECTOR

(75) Inventor: Seigi Toiyama, Okazaki (JP)

(73) Assignee: DENSO Corporation, Kariya (JP)

( * ) Notice: Subject to any disclaimer, the term of this patent is extended or adjusted under 35 U.S.C. 154(b) by 371 days.

(21) Appl. No.: 10/693,956

(22) Filed: Oct. 28, 2003

(65) Prior Publication Data

US 2004/0089730 A1 May 13, 2004

(30) Foreign Application Priority Data

Oct. 30, 2002 (JP) ..... 2002-316268

(51) Int. Cl.

| | |
|---|---|
| ***F02M 59/20*** | (2006.01) |
| ***F02M 61/20*** | (2006.01) |
| ***F02M 65/00*** | (2006.01) |
| ***B05B 17/04*** | (2006.01) |
| ***B05B 1/30*** | (2006.01) |

(52) U.S. Cl. ..... 239/5; 239/11; 239/585.1; 239/533.6; 239/533.9; 251/129.04; 251/129.18; 73/119 A

(58) Field of Classification Search ..... 239/5, 239/11, 585.1, 585.3, 585.5, 533.3, 533.6, 239/533.9, 585.2, 585.4, 533.2; 251/129.04, 251/129.18, 129.16; 123/494, 478, 480; 73/119 A, 115

See application file for complete search history.

(56) References Cited

U.S. PATENT DOCUMENTS 5,157,967 A * 10/1992 Wieczorek ..... 73/119 A
5,241,858 A * 9/1993 Wieczorek et al. ..... 73/119 A
5,301,874 A 4/1994 Vogt et al.
5,383,606 A * 1/1995 Stegmaier et al. ..... 239/575
6,409,094 B1 * 6/2002 Tojo et al. ..... 239/5
2003/0094514 A1 * 5/2003 Luft ..... 239/533.9
2004/0011898 A1 * 1/2004 Luft ..... 239/585.1

FOREIGN PATENT DOCUMENTS

DE 4211723 A1 * 4/1993
DE 19516513 A1 * 11/1996

OTHER PUBLICATIONS

Surface Vehicle Recommended Practice; "Low Pressure Gasoline Fuel Injector"; SAE International; Issued Nov. 1989; Revised Feb. 2001; pp. 1-60.

* cited by examiner

*Primary Examiner*—David A. Scherbel
*Assistant Examiner*—Darren Gorman
(74) *Attorney, Agent, or Firm*—Nixon & Vanderhye P.C.

(57) ABSTRACT

In a dynamic flow rate adjusting method, a press-fitting degree of an adjusting pipe is adjusted to regulate a load applied to a needle by a spring in a direction for closing an injection hole. Thus, a dynamic injection quantity of an injector is adjusted. An injection command signal having one-minute long pulse width is applied to the injector to measure a static flow rate, from which the press-fitting degree is calculated. Thus, the press-fitting degree, in which variation in the static flow rate is taken into consideration, can be calculated. Therefore, variation in the dynamic flow rate of each injector, which is calculated from the press-fitting degree, includes only a dynamic flow rate error, while a static flow rate error is eliminated from the variation in the dynamic flow rate.

14 Claims, 8 Drawing Sheets

DYNAMIC FLOW RATE ADJUSTING METHOD FOR INJECTOR

CROSS REFERENCE TO RELATED APPLICATION

This application is based on and incorporates herein by reference Japanese Patent Application No. 2002-316268 filed on Oct. 30, 2002.

BACKGROUND OF THE INVENTION

1. Field of the Invention

The present invention relates to a dynamic flow rate adjusting method for an injector.

2. Description of Related Art

An adjusting system shown in FIG. 1 adjusts a dynamic flow rate of an injector 1. The dynamic flow rate of fluid injected by the injector 1 is adjusted by regulating biasing force of a spring 21. The biasing force of the spring 21 is regulated by adjusting a press-fitting position of an adjusting pipe 23. The dynamic flow rate is quantity of fluid injected during a stroke (opening and closing motion) of a needle 30. The injector 1 injects experimental fluid through injection holes 25 when the needle 30 as a valve member separates from a valve seat 27. As the experimental fluid, incombustible fluid having substantially the same viscosity as the fuel is used in order to prevent ignition and the like. The spring 21 as a biasing member biases the needle 30 in a direction for seating the needle 30 on the valve seat 27, or a direction for closing the injection holes 25. The adjusting pipe 23 is driven to an inside of a housing 10 of the injector 1 when press-fitted. When the press-fitting position of the adjusting pipe 23 is determined and the target dynamic flow rate is achieved, the adjusting pipe 23 is fixed to the housing 10 by crimping and the like. If current is supplied to a coil 50 as an electric driving member, magnetic force is generated for attracting the needle 30 toward a fixed core 22 (upward in FIG. 1) against the biasing force of the spring 21. Thus, the needle 30 separates from the valve seat 27. A maximum lifting distance of the needle 30 is defined by the position of the fixed core 22.

A pump 100 draws the experimental fluid from a tank 101 to the injector 1. A pressure gauge 102 measures pressure of the fluid supplied to the injector 1. A flowmeter 103 as measuring means measures the flow rate of the fluid flowing through the injector 1. For instance, the flowmeter 103 outputs a pulse number of pulse signals generated per unit time in accordance with the flow rate, as a flow rate signal. The pulse number outputted by the flowmeter 13 increases as the flow rate increases. A back pressure valve 104 regulates the pressure of the fluid supplied to the injector 1 to a predetermined pressure. A pressure reducing valve may be employed instead of the back pressure valve 104. A motor gear 111 rotating with a motor 110 as an adjusting amount changing means is meshed with a screw gear 112. The screw gear 112 is connected with a driving screw 113 in thread engagement. If the screw gear 112 rotates, the driving screw 113 moves upward or downward in FIG. 1. If the driving screw 113 moves downward, the adjusting pipe 23 is driven to the inside of the housing 10. A personal computer (PC) 120 as calculating means receives the flow rate signal outputted by the flowmeter 103 and calculates the dynamic flow rate corresponding to the present press-fitting position of the adjusting pipe 23. The PC 120 controls a driving circuit 121 based on a difference between the calculated dynamic flow rate and the target dynamic flow rate. Thus, the PC 120 regulates controlling current supplied to the motor 110 from the driving circuit 121. The PC 120 calculates the press-fitting position of the adjusting pipe 23 for the next time.

If the adjusting pipe 23 is driven into the housing 10, the biasing force of the spring 21 is increased. If the adjusting pipe 23 is press-fitted, a valve opening period To of the injector 1 is lengthened, and a valve closing period Tc is contracted as shown in FIG. 9 in the case where the coil 50 is applied with the controlling pulse current having an identical frequency, an identical pulse width and an identical amplitude. Therefore, a time length of one injection performed by the injector 1 is contracted and the injection quantity is reduced. Accordingly, the dynamic flow rate calculated by the PC 120 based on the flow rate signal outputted by the flowmeter 103 is reduced. The valve opening period To is a time length from the time when an injection pulse signal for commanding the injection is turned on to the time when the needle 30 separates from the valve seat 27 and the needle 30 is stopped by the fixed core 22, so a lifting distance of the needle 30 is maximized. The valve closing period Tc is a time length from the time when the injection pulse signal is turned off to the time when the needle 30 is seated on the valve seat 27 and the injection is stopped. In FIG. 9, an axis qb represents the flow rate before the adjusting pipe 23 is press-fitted, and an axis qa is the flow rate after the adjusting pipe 23 is press-fitted.

A conventional adjusting method of the dynamic flow rate performed with the adjusting pipe 23 will be explained based on FIGS. 10 and 11. In FIG. 10, an axis of abscissas represents the press-fitting degree L of the adjusting pipe 23 and an axis of ordinates represents the dynamic flow rate q. A symbol qt on the axis q represents the target dynamic flow rate. The press-fitting degree L as an adjusting amount of the adjusting pipe 23 represents displacement of the adjusting pipe 23 from an initial position to the position where the adjusting pipe 23 is press-fitted. In the case where a plurality of injectors 1 having identical structure are adjusted, an average value of a rate of change (a change rate Kq) of the dynamic flow rate q with respect to the press-fitting degree L of the adjusting pipe 23 is calculated in advance from measurements of the injectors 1. Then, the press-fitting degree L of the adjusting pipe 23 for achieving the target dynamic flow rate qt is calculated based on the change rate Kq.

However, the dynamic flow rate q includes a dynamic flow rate error Ed and a static flow rate error Es of a static flow rate as shown in FIG. 10. Therefore, if the press-fitting degree L of the adjusting pipe 23 for the present adjustment is calculated from the above change rate Kq, there is a possibility that the press-fitting degree L may become too large. The static flow rate represents a flow rate of fluid injected by the injector 1 when the injector 1 injects the fluid continuously for a predetermined period. The static flow rate error Es is an error in the flow rate caused by errors generated in processing steps of parts constituting the injector 1. For instance, the static flow rate error Es is caused by variation in an opening area of the fluid passage at the time when the needle 30 is lifted or by variation in the maximum lifting distance of the needle 30. The dynamic flow rate error Ed represents an error in the flow rate caused by the error in electromagnetic characteristics of the coil 50 and elastic characteristics of the spring 21. Thus, in the conventional adjusting method for achieving the target dynamic flow rate qt based on the change rate Kq of the dynamic flow rate q with respect to the press-fitting degree L of the adjusting pipe 23, the change rate Kq includes the dynamic flow rate error Ed and the static flow rate error Es.

If the press-fitting degree L of the adjusting pipe 23 is too large, there is a possibility that the dynamic flow rate q may become smaller than the target dynamic flow rate qt. The position of the adjusting pipe 23 is fixed by press-fitting. Therefore, if the press-fitting degree L is too large, the adjusting pipe 23 cannot be brought back.

Therefore, in the case where the press-fitting degree L of the adjusting pipe 23 is calculated based on the change rate Kq of the dynamic flow rate q with respect to the press-fitting degree L, a rate of change in the press-fitting degree L per press-fitting process has to be reduced in order not to drive the adjusting pipe 23 excessively during the adjustment of the dynamic flow rate q. Therefore, as shown in FIG. 11, the number of times to drive the adjusting pipe 23 is increased until the dynamic flow rate 1 reaches a standard area Rqt corresponding to the target dynamic flow rate qt and a time length for the adjustment is lengthened. Heavy lines "CHECK" in FIG. 11 represent periods in which the dynamic flow rate q is measured and the press-fitting degree L of the adjusting pipe 23 is calculated.

SUMMARY OF THE INVENTION

It is therefore an object of the present invention to provide a dynamic flow rate adjusting method for an injector capable of contracting an adjusting period.

According to an aspect of the present invention, in a dynamic flow rate adjusting method, an adjusting amount of an adjuster is calculated based on a static flow rate. Thus, a static flow rate error included in the dynamic flow rate can be considered in the calculation of the adjusting amount of the adjuster. Since the dynamic flow rate is calculated by adjusting the adjusting amount of the adjuster and variation in the dynamic flow rate for each injector is small, the adjuster can reach a target adjusting position for achieving the target dynamic flow rate qt in a small number of the adjustments. Thus, the adjusting period can be contracted. If the number of the injectors 1 to be adjusted is constant, the number of the adjusting systems can be reduced.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
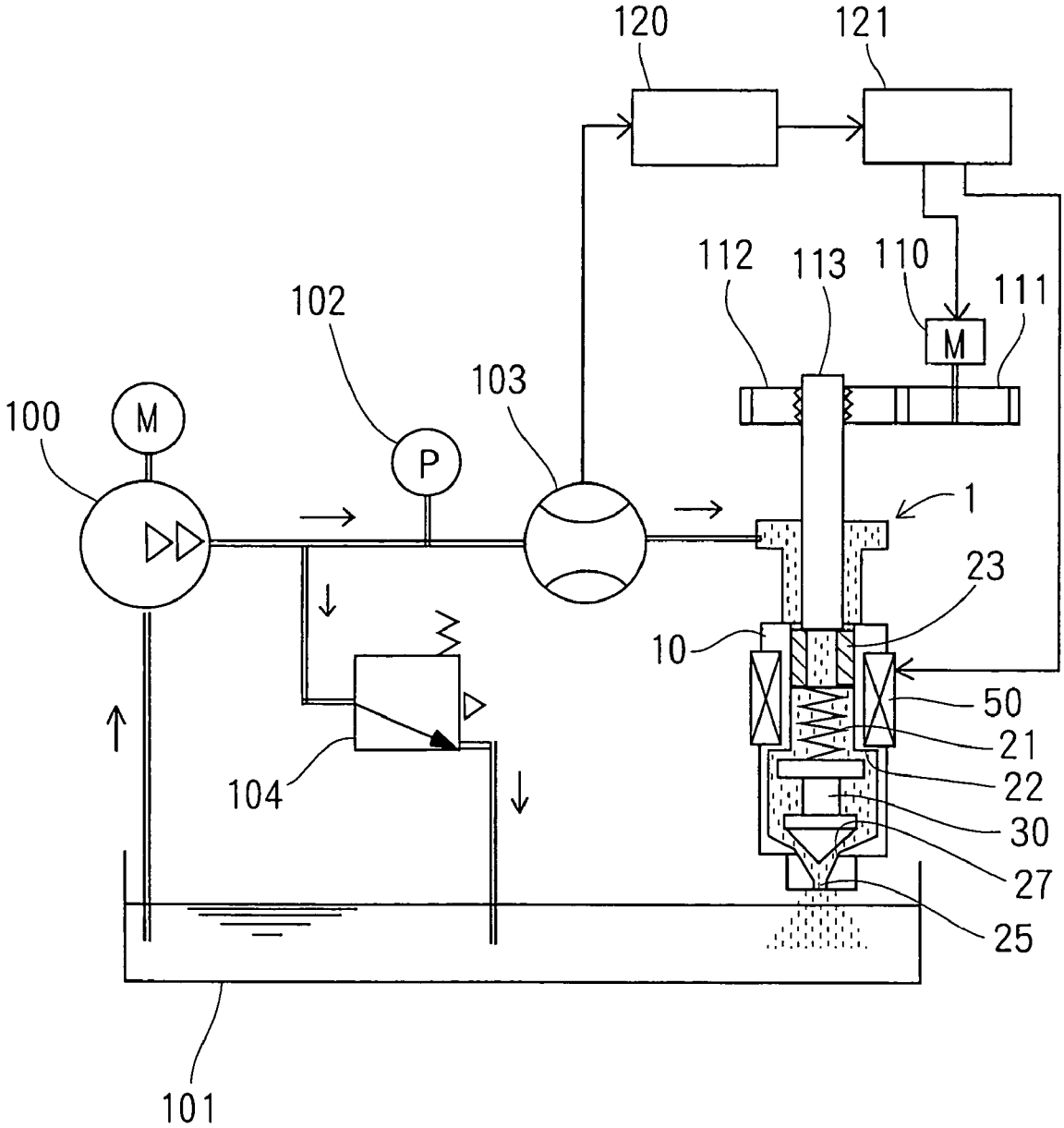
FIG. 1 is a schematic diagram showing an adjusting system for an injector according to an embodiment of the present invention.
Figure 2:
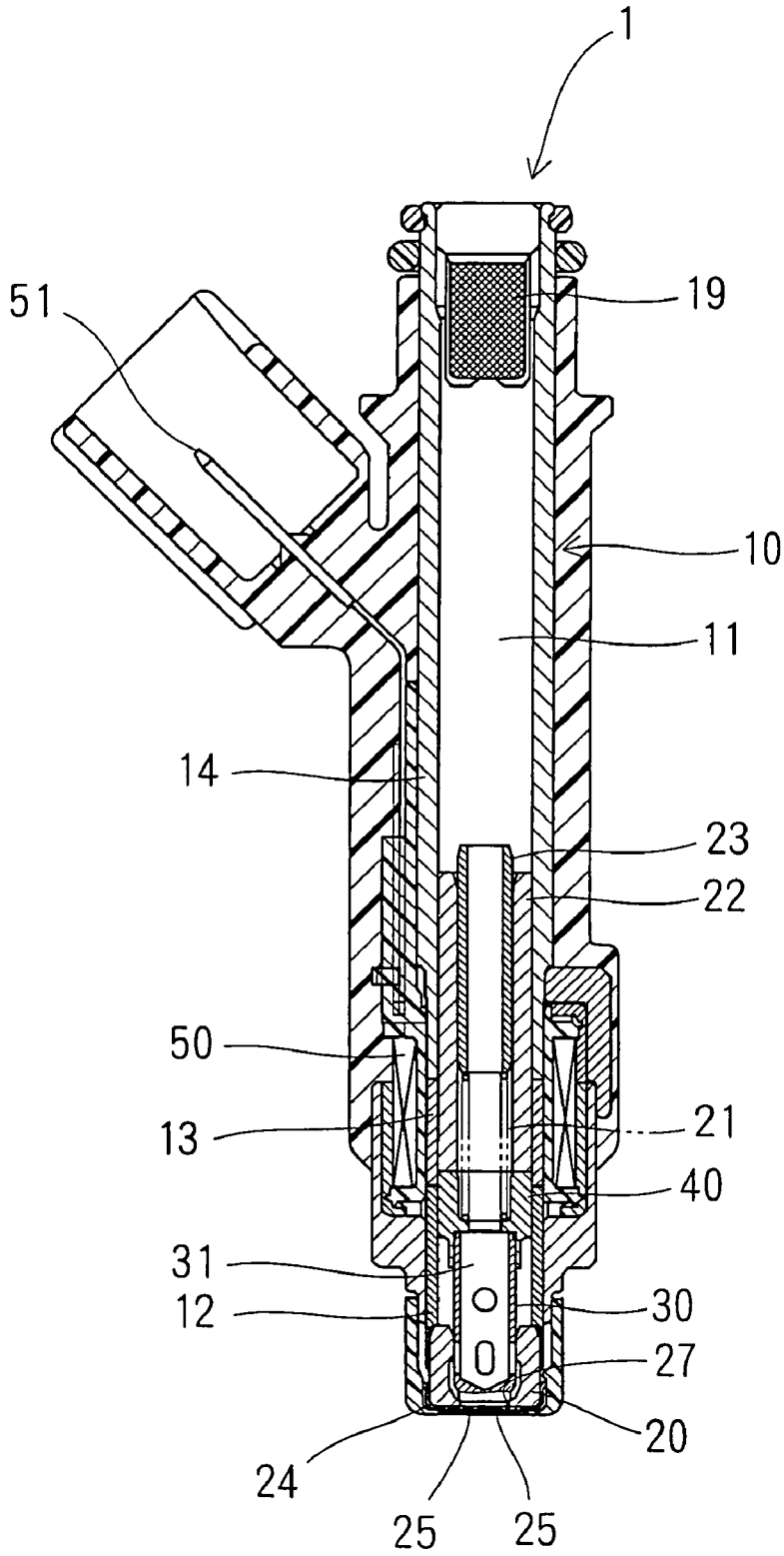
FIG. 2 is a longitudinal sectional view showing the injector according to the embodiment.

Referring to FIG. 2, an injector 1 according to the embodiment of the present invention is illustrated. A dynamic flow rate adjusting system of the present embodiment has substantially the same structure as the conventional dynamic flow rate adjusting system shown in FIG. 1.

A housing 10 of the injector 1, which injects fuel, is formed in the shape of a cylinder, which is formed of magnetic members and a nonmagnetic member. The housing 10 is formed with a fuel passage 11. The fuel passage 11 accommodates a valve body 20, a spring 21, a fixed core 22, an adjusting pipe 23, a needle 30 as a valve member, a movable core 40 and the like.

The housing 10 has a first magnetic member 12, a nonmagnetic member 13 and a second magnetic member 14 in that order from a valve body 20 side, which is positioned in a lower area in FIG. 2. The first magnetic member 12 is welded with the nonmagnetic member 13, and the nonmagnetic member 13 is welded with the second magnetic member 14 by laser welding and the like. The nonmagnetic member 13 prevents short circuit of magnetic flux between the first magnetic member 12 and the second magnetic member 14. The valve body 20 is fixed by welding on a side of the first magnetic member 12 opposite from the nonmagnetic member 13.

The fixed core 22 is formed in the shape of a cylinder. The fixed core 22 is press-fitted to the insides of the nonmagnetic member 13 and the second magnetic member 14. Thus, the fixed core 22 is fixedly attached to the housing 10. The fixed core 22 is disposed on a side of the movable core 40 opposite from the injection holes 25, so the fixed core 22 faces the movable core 40.

The adjusting pipe 23 is press-fitted to the inside of the fixed core 22. An end of the spring 21 contacts the adjusting pipe 23 and the other end of the spring 21 contacts the movable core 40. The load applied to the needle 30 by the spring 21 is changed by adjusting the press-fitting degree (an adjusting amount) of the adjusting pipe 23. The spring 21 biases the needle 30 toward the valve seat 27, or in a direction for closing the injection holes 25.

An injection plate 24 formed of a thin plate in the shape of a cup is fixed to a peripheral wall of the valve body 20 by welding. The plurality of injection holes 25 is formed at the center of the injection plate 24.

The needle 30 is formed in the shape of a hollow cylinder with a bottom surface. A fuel passage 31 is formed inside the needle 30. The needle 30 can be seated on the valve seat 27 formed in an inner peripheral wall of the valve body 20. If the needle 30 is seated on the valve seat 27, the injection holes 25 are closed and the fuel injection is stopped.

The movable core 40 is disposed on a side of the needle 30 opposite from the injection holes 25. The needle 30 is formed with fuel holes, which penetrate the side wall of the needle 30. The fuel flowing into the fuel passage 31 of the needle 30 passes through the fuel holes and flows to a valve portion provided by the needle 30 and the valve seat 27. The coil 50 is electrically connected with a terminal 51, through which driving current is supplied to the coil 50. If the driving current is supplied to the coil 50, the movable core 40 is attracted toward the fixed core 22. Thus, the needle 30 separates from the valve seat 27 and the fuel is injected from the injection holes 25. The maximum lifting distance of the needle 30 is provided when the fixed core 22 stops the movable core 40, which is attracted by the coil 50.

A filter 19 eliminates extraneous matters included in the fuel flowing into the fuel passage 11 from the upper side in FIG. 2. The fuel, from which the extraneous matters are eliminated, is supplied to the valve portion through the fuel passage 11, a radially inner area of the adjusting pipe 23, a radially inner area of the fixed core 22, a radially inner area of the movable core 40, the fuel passage 31 of the needle 30 and the fuel holes penetrating the side wall of the needle 30. The fuel supplied to the valve portion flows to the injection holes 25 when the needle 30 separates from the valve seat 27 and is injected from the injection holes 25.

Next, a dynamic flow rate adjusting method for the injector 1 of the present embodiment will be explained.

Figure 4:
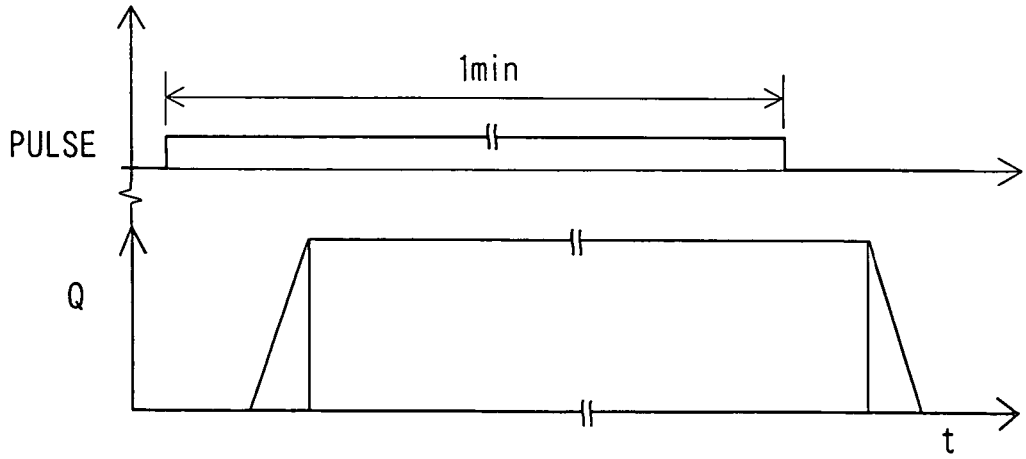
FIG. 4 is a characteristic diagram showing a relationship between the time and the flow rate during a static injection performed by the injector according to the embodiment.
Figure 6:
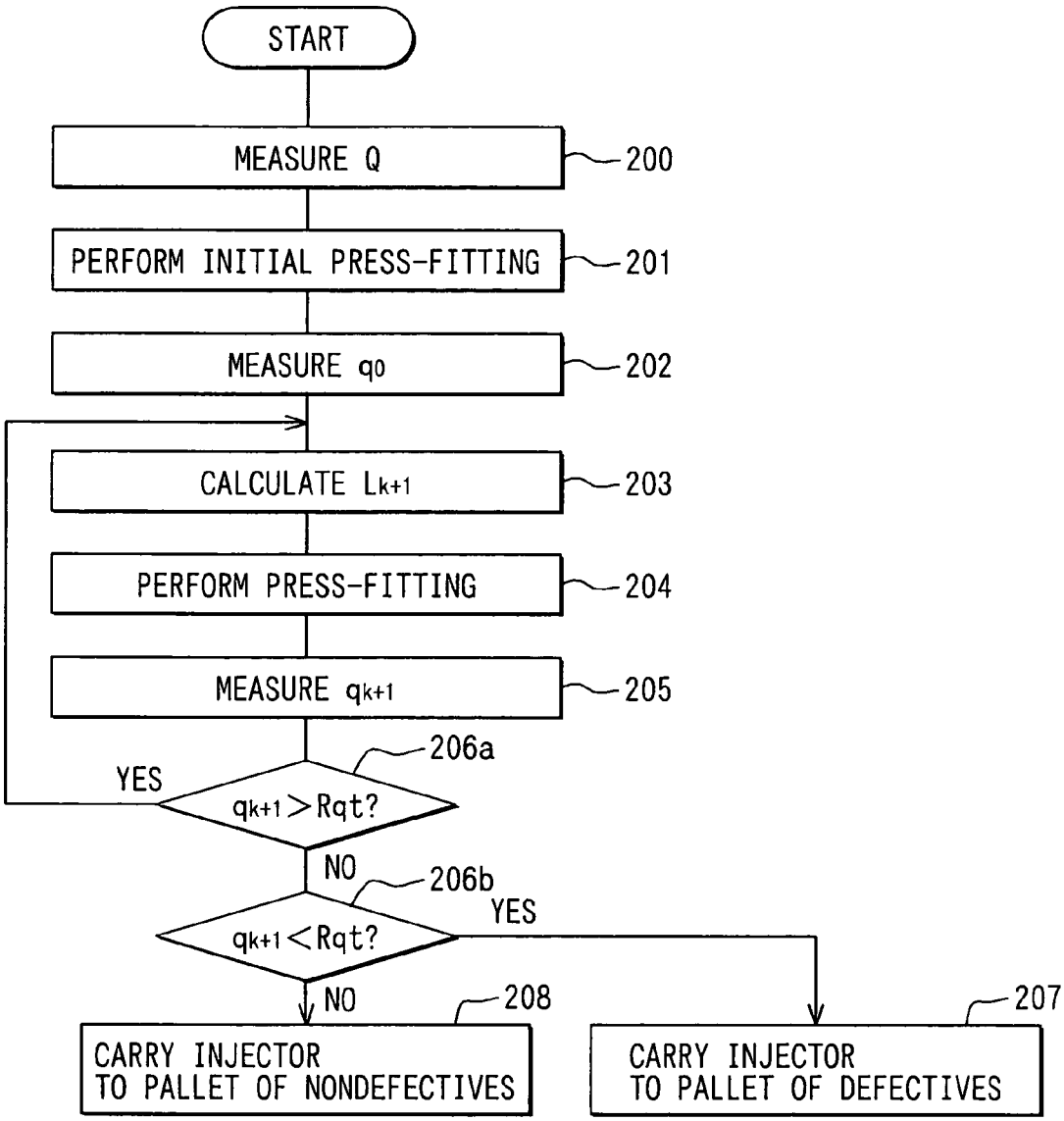
FIG. 6 is a schematic flowchart showing steps of adjustment according to the embodiment.

First, before measuring the dynamic flow rate q, a static flow rate Q is measured with static flow rate measuring means in Step 200 of the flowchart shown in FIG. 6. More specifically, the fixed core 22 is press-fitted to a predetermined position based on data acquired from the plurality of injectors 1 having identical structure. Then, an injection command signal having a predetermined pulse width (for instance, a pulse width of one minute as shown in FIG. 4) is applied to the injector 1, and the static flow rate Q (cc/min) is measured.

Figure 5A:
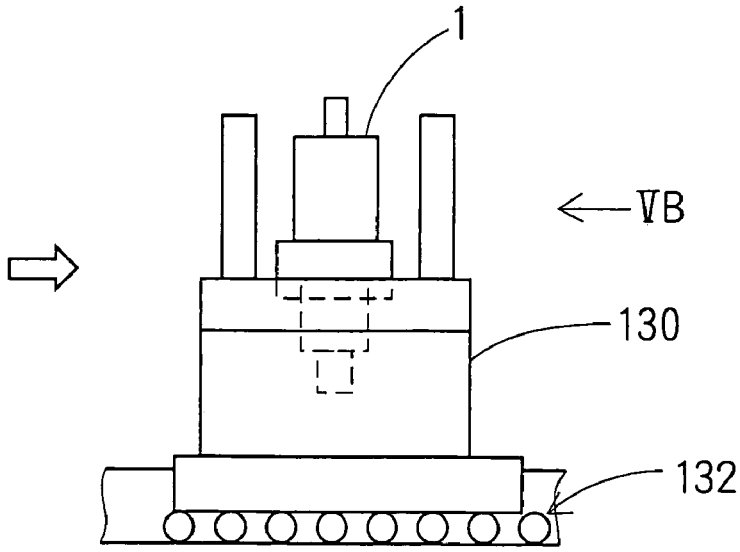
FIG. 5A is a diagram showing a method for carrying the injector according to the embodiment.
Figure 5B:
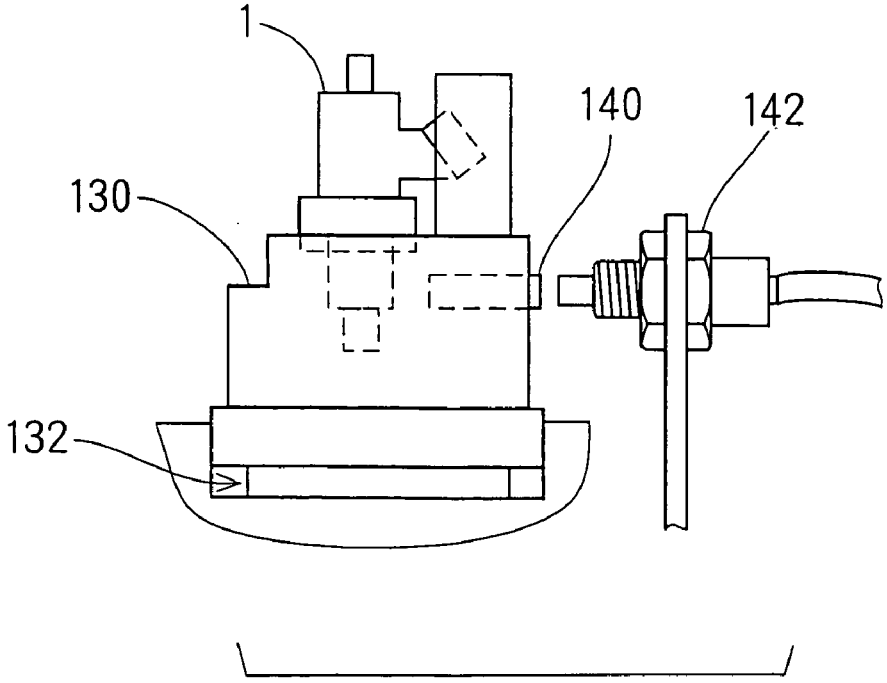
FIG. 5B is a diagram showing the injector according to the embodiment along an arrow mark VB in FIG. 5A.

Then, the injector 1, whose static flow rate Q is measured, is mounted on a pallet 130 and is carried to the adjusting system shown in FIG. 1 by a carrier 132 as shown in FIGS. 5A and 5B. An ID tag 140 storing information of each injector 1 such as a part number and the static flow rate Q thereof is attached to the pallet 130. The static flow rate Q of the injector 1 is scanned by an ID tag sensor 142 and is stored in the PC 120 before the injector 1 is set to the dynamic flow rate adjusting system.

Then, in Step 201, the adjusting pipe 23 is press-fitted to an initial position L0 by using the motor 110 (adjusting amount changing means) as press-fitting means. More specifically, the injector 1 is set to the dynamic flow rate adjusting system, and the pressure of the fluid supplied from the pump 100 to the injector 1 is controlled to a predetermined pressure with the back pressure valve 104. Then, the motor 110 is rotated to press-fit and carry the adjusting pipe 23 to the predetermined initial position L0 so that the spring 21 exerts the biasing force to a degree that the needle 30 is seated on the valve seat 27.

Then, in Step 202, the initial dynamic flow rate q0 ($mm^3$/str) is measured by using the flowmeter 103 (measuring means) and the PC 120 (calculating means) as dynamic flow rate measuring means. More specifically, the PC 120 controls the driving circuit 121 to supply the injector 1 with the injection pulse signal having a predetermined frequency, a predetermined pulse width and a predetermined amplitude. The PC 120 calculates the initial dynamic flow rate q0 ($mm^3$/str), or a flow rate per injection at the time when the adjusting pipe 23 is set at the initial position L0, based on the pulse number of the pulse signals generated by the flowmeter 103 per unit time in accordance with the flow rate.

The calculation of the dynamic flow rate $q_k$ (k is an integer number starting from 0) at the time when the adjusting pipe 23 is press-fitted to the press-fitting position $L_k$ (k is an integer number starting from 0) will be explained based on FIG. 3.

Figure 3:
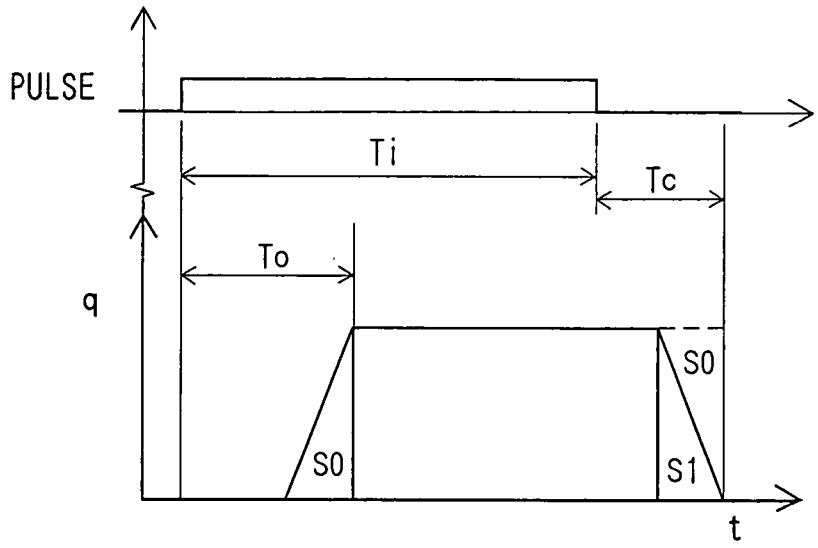
FIG. 3 is a characteristic diagram showing a relationship between time and a flow rate during a dynamic injection performed by the injector according to the embodiment.

In FIG. 3, Ti represents an injection command period provided by the injection pulse signal, To is a valve opening period and Tc is a valve closing period. As shown in FIG. 3, an area S0, which is provided by integrating the flow rate q since the needle 30 separates from the valve seat 27 until the needle 30 is stopped by the fixed core 22, is assumed to be equal to an area S1, which is provided by integrating the flow rate q since the needle 30 separates from the fixed core 22 until the needle 30 is seated on the valve seat 27. Therefore, in the case where the fluid of the dynamic flow rate q shown in FIG. 3 is injected in a state in which the needle 30 is stopped by the fixed core 22 and is fully opened, an effective injection period Te is calculated by a following equation (1).

$$Te=Ti+Tc-To=Ti-(To-Tc), \quad (1)$$

In the effective injection period (Ti−(To−Tc)), a period (To−Tc) provided by subtracting the valve closing period Tc from the valve opening period To is referred to as an ineffective injection period Tv, hereafter. If the injection is performed when the needle 30 is stopped by the fixed core 22 and is fully opened, the dynamic flow rate q ($mm^3$/str) per unit time (msec) can be calculated by converting the static flow rate Q (cc/min) into the flow rate Q' ($mm^3$/msec), or the flow rate Q/60 ($mm^3$/msec). Therefore, the dynamic flow rate $q_k$ ($mm^3$/str) at the time when the adjusting pipe 23 is disposed at the press-fitting position $L_k$ is represented by a following equation (2). In the equation (2), $Tv_k$ (msec) (k is an integer number starting from 0) represents the ineffective injection period. Since the flow rate $q_k$ and the static flow rate Q are the measured values and the injection command period Ti is the set value, the ineffective injection period $Tv_k$ can be calculated by the equation (2).

$$q_k=(Q/60)\times(Ti-Tv_k)$$

$$Tv_k=Ti-(60\times q_k/Q), \quad (2)$$

The target ineffective injection period Tvt can be represented by a following equation (3). In the equation (3), qt represents the target dynamic flow rate. Since the static flow rate Q is the measured value and the injection command period Ti and the target dynamic flow rate qt are the set values, the target ineffective injection period Tvt can be calculated by the equation (3).

$$qt=(Q/60)\times(Ti-Tvt)$$

$$Tvt=Ti-(60\times qt/Q), \quad (3)$$

Then, in Step 203, the press-fitting degree L of the adjusting pipe 23 is calculated by using the PC 120 (the calculating means) as press-fitting degree calculating means. A press-fitting position $L_{k+1}$ of the adjusting pipe 23 can be calculated by a following equation (4).

$$L_{k+1}=L_k+\Delta L$$

$$L_{k+1}=L_k+(Tvt-TV_k)/Kt, \quad (4)$$

In the equation (4), Kt (msec/mm) represents an adjustment coefficient as a rate of change in the ineffective injection period Tv with respect to the press-fitting degree L of the adjusting pipe 23. ΔL represents an increase in the press-fitting degree L from the previous press-fitting position $L_k$ to the present press-fitting position $L_{k+1}$ for press-fitting the adjusting pipe 23 to achieve the target dynamic flow rate qt.

The press-fitting degree L of the adjusting pipe 23 is the displacement from the initial position L0 to the position where the adjusting pipe 23 is press-fitted. The adjustment coefficient Kt used in the present adjustment is an average value of the adjustment coefficients Kt calculated for the respective injectors 1 by the previous adjustment. The ineffective injection period $Tv_k$ is calculated by the equation (2), and the target ineffective injection period Tvt is calculated by the equation (3). The adjustment coefficient Kt is a known value. Therefore, the press-fitting position $L_{k+1}$ can be calculated by the equation (4).

Figure 7:
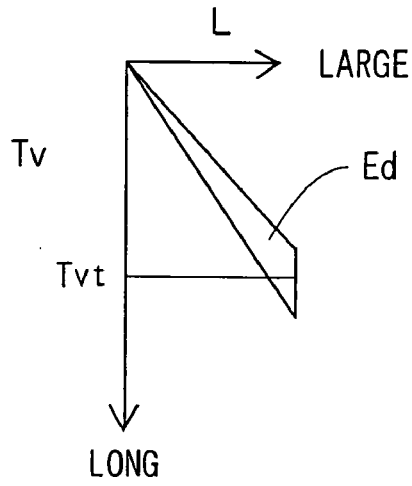
FIG. 7 is a characteristic diagram showing a relationship between a press-fitting degree of an adjusting pipe and an ineffective injection period according to the embodiment.

The ineffective injection period $Tv_k$ and the target ineffective injection period Tvt are calculated from the static flow rate Q treated as a variable, based on the equations (2) and (3). The press-fitting position $L_{k+1}$ is calculated from the ineffective injection period $Tv_k$ and the target ineffective injection period Tvt treated as variables, based on the equation (4). The press-fitting position $L_{k+1}$ is a value calculated from the static flow rate Q treated as the variable, based on the equations (2), (3) and (4). Thus, the press-fitting position $L_{k+1}$ is a value in which the variation in the static flow rate Q among the respective injectors 1 is considered. As shown in FIG. 7, the relationship between the ineffective injection period $Tv_k$ and the target ineffective injection period Tvt includes only the dynamic flow rate error Ed, because the static flow rate error Es due to the variation in the static flow rate Q is taken into consideration.

The increase ΔL in the press-fitting degree L of the adjusting pipe 23 is calculated by the equation (4). Therefore, the increase ΔL is a value calculated from the static flow rate Q treated as the variable. Therefore, the increase ΔL in the press fitting degree L of the adjusting pipe 23 is a value in which the variation in the static flow rate Q among the respective injectors 1 is taken into consideration. If the difference Δq between the dynamic flow rate qk and the target dynamic flow rate qt is constant, a value $(Tvt-Tv_k)$ provided by subtracting the ineffective injection period $Tv_k$ from the target ineffective injection period Tvt decreases as the static flow rate Q increases as shown by a following equation (5).

$$\Delta q = q_k - qt$$

$$\Delta q = (Q/60)\times(Ti - TV_k) - (Q/60)\times(Ti - Tvt)$$

$$\Delta q = (Q/60)\times(Tvt - TV_k), \quad (5)$$

More specifically, if the difference Δq between the dynamic flow rate $q_k$ and the target dynamic flow rate qt is constant, the increase ΔL in the press-fitting degree L of the adjusting pipe 23 calculated by the equation (4) decreases as the static flow rate Q increases.

Then, in Step 204, the adjusting pipe 23 is driven and press-fitted to the calculated press-fitting position $L_{k+1}$ by rotating the motor 110 as the press-fitting means.

Then, in Step 205, the dynamic flow rate $q_{k+1}$ after the adjusting pipe 23 is press-fitted is calculated by using the flowmeter 103 (the measuring means) and the PC 120 (the calculating means) as the dynamic flow rate measuring means, like the initial dynamic flow rate q0 measured in Step 202.

Figure 8:
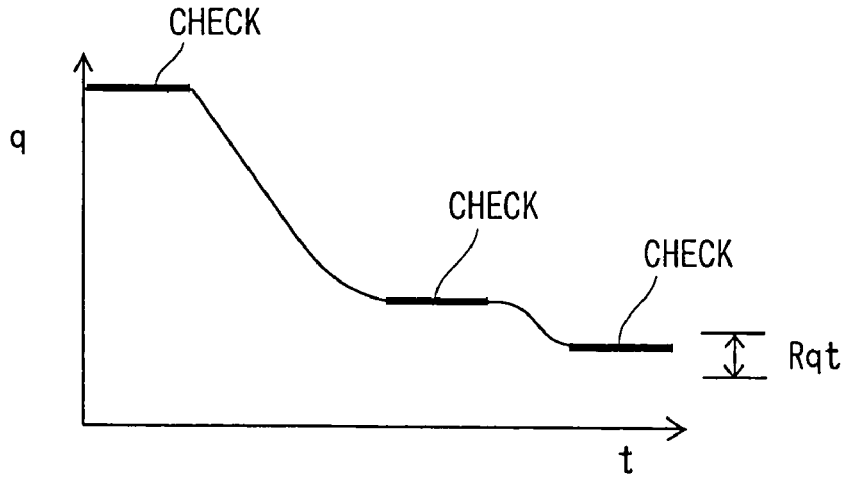
FIG. 8 is a characteristic diagram showing an adjusting process of the dynamic flow rate according to the embodiment.
Figure 9:
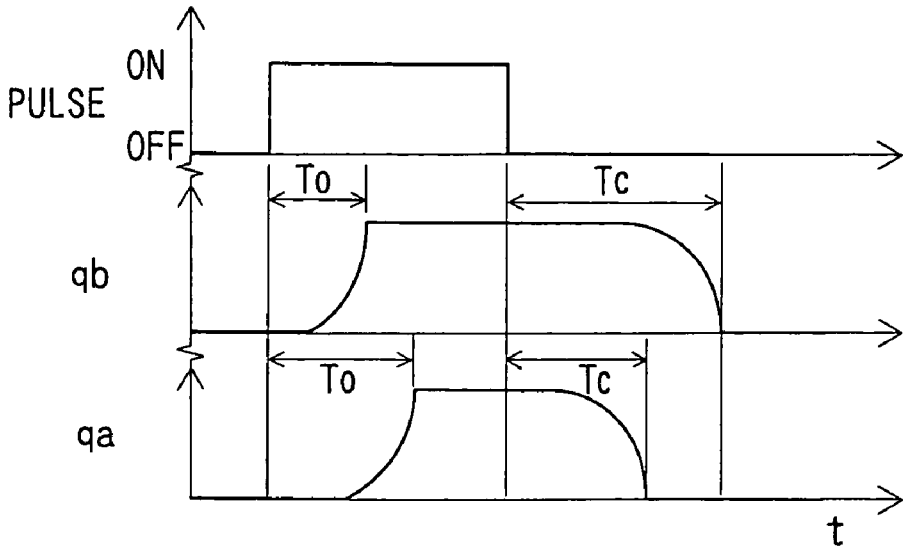
FIG. 9 is a characteristic diagram showing a change in the flow rate between an injection before the adjusting pipe is press-fitted and an injection after the adjusting pipe is press-fitted.
Figure 10:
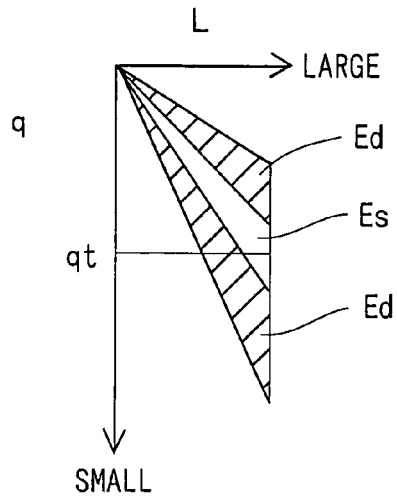
FIG. 10 RELATED ART
FIG. 10 is a characteristic diagram showing a relationship between a press-fitting degree of an adjusting pipe and a dynamic flow rate of a conventional technology.
Figure 11:
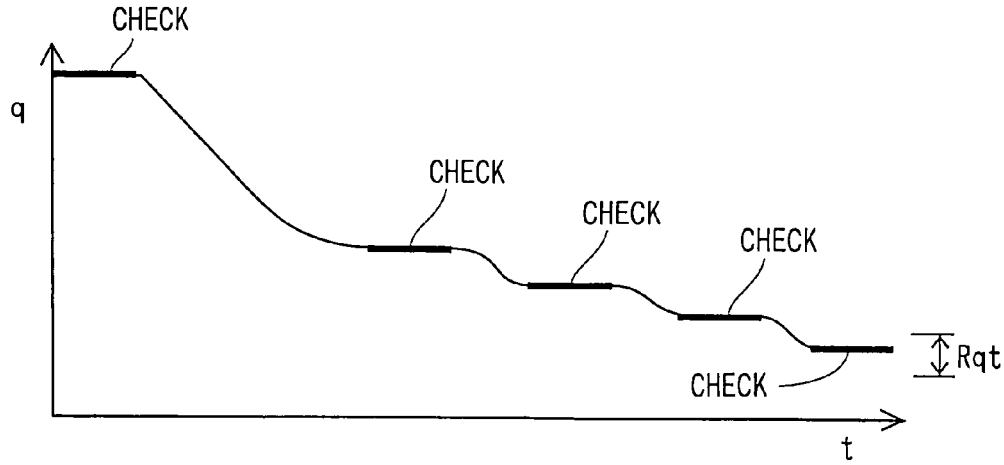
FIG. 11 RELATED ART
FIG. 11 is a characteristic diagram showing an adjusting process of the flow rate of the conventional technology.

Then, in Step 206*a*, it is determined whether the dynamic flow rate $q_{k+1}$ calculated in Step 205 is greater than a standard range Rqt corresponding to the target dynamic flow rate qt or not by using the PC 120 (the calculating means) as determining means. If the result of the determination in Step 206*a* is "YES", the processing returns to Step 203 and the adjustment is repeated as shown in FIG. 8. If the result of the determination in Step 206*a* is "NO", the processing proceeds to Step 206*b*. In Step 206*b*, it is determined whether the dynamic flow rate $q_{k+1}$ calculated in Step 205 is less than the standard range Rqt of the target dynamic flow rate qt or not by using the PC 120 (the calculating means) as the determining means. If the result of the determination in Step 206*b* is "YES", it is determined that the adjusting pipe 23 is press-fitted excessively. In this case, the injector 1 is considered as a defective and is carried to a pallet for the defective injectors 1 in Step 207. If the result of the determination in Step 206*b* is "NO", the injector 1 is considered as a nondefective and is carried to another pallet for the nondefective injectors 1 in Step 208.

If the injector 1 is nondefective, the ineffective injection period $Tv_{k+1}$ is calculated by the equation (2), and the adjustment coefficient Kt for the present adjustment is calculated by a following equation: $Kt=(Tv_{k+1}-Tv0)/(L_{k+1}-L0)$. Then, the presently adjusted injector 1 is added to samples, and the average value of the adjustment coefficients Kt is calculated as the adjustment coefficient Kt for the next adjustment.

In the above embodiment, the increase ΔL in the press-fitting degree L of the adjusting pipe 23 is calculated from the static flow rate Q measured in advance. Thus, the increase ΔL in the press-fitting degree L, in which the variation in the static flow rate Q among the injectors 1 is taken into consideration, can be calculated. The dynamic flow rate q of each injector 1 is calculated from the increase ΔL in the press-fitting degree L calculated with the use of the adjustment coefficient Kt. Therefore, the variation in the dynamic flow rate q includes only the dynamic flow rate error Ed due to the elastic characteristics of the spring 21, the electromagnetic characteristics of the coil 50 and the like. The static flow rate error Es is eliminated from the variation in the dynamic flow rate q. Thus, the variation in the dynamic flow rate q is reduced, and the dynamic flow rates q of almost all the injectors 1 can be adjusted into the standard range Rqt of the target dynamic flow rate qt. Therefore, there is no need to make the increase ΔL in the press-fitting degree L smaller than the value calculated by the equation (4) to prevent the actual dynamic flow rate from becoming smaller than the standard range Rqt of the target dynamic flow rate qt. The dynamic flow rate becomes smaller than the standard range Rqt of the target dynamic flow rate qt when the press-fitting degree L of the adjusting pipe 23 is too large. In addition, the possibility that the dynamic flow rate q reaches the standard range Rqt of the target dynamic flow rate qt in a single adjustment is increased. Therefore, the number of times for performing the adjustment can be reduced and the adjusting period can be contracted.

(Modifications)

In the present embodiment, the rate of change in the ineffective injection period Tv with respect to the press-fitting degree L of the adjusting pipe 23 is employed as the adjustment coefficient Kt. Instead of the ineffective injection period Tv, the rate of change in the effective injection period (Ti+Tc−To) with respect to the press-fitting degree L of the adjusting pipe 23 may be employed as the adjustment coefficient Kt. Thus, the press-fitting degree L of the adjusting pipe 23 for achieving the target dynamic flow rate qt may be calculated.

In the present embodiment, the press-fitting degree L of the adjusting pipe 23 press-fitted into the housing 10 is adjusted in order to regulate the load of the spring 21. Thus, the dynamic flow rate q is adjusted. Instead of the adjusting pipe 23 fixed by press-fitting, any other member fixed by screwing or welding after inserted to the fixed core 22 can be employed as the adjuster if the member can change the load of the spring 21.

In the injector 1 of the present embodiment, the fixed core 22 stops the needle 30, and the maximum lifting distance of the needle 30 is defined by the press-fitting position of the fixed core 22. Instead of the fixed core 22, a dedicated stopper for stopping the needle 30 may be employed, and the maximum lifting distance of the needle 30 may be defined by the position of the stopper.

The present invention should not be limited to the disclosed embodiment, but may be implemented in many other ways without departing from the spirit of the invention.

What is claimed is:

1. A dynamic flow rate adjusting method for an injector, which has a valve member for opening or closing an injection hole, an electric driving member for driving the valve member to open or close and an adjuster for adjusting injection quantity of fluid injected from the injection hole by the injector, the dynamic flow rate adjusting method comprising the steps of:

measuring a flow rate of the fluid flowing through the injector;

changing an adjusting amount of the adjuster;

measuring a static flow rate of the injector;

calculating the adjusting amount of the adjuster for achieving a target dynamic flow rate based on the measured static flow rate of the injector.

2. The dynamic flow rate adjusting method for the injector as in claim 1, wherein the injector has a biasing member for biasing the valve member in a direction for closing the injection hole, the electric driving member drives the valve member in a direction for opening the valve member against biasing force of the biasing member, the adjuster contacts the biasing member, and the adjusting amount of the adjuster is adjusted to regulate a load, which is applied to the valve member by the biasing member in the direction for closing the injection hole.

3. The dynamic flow rate adjusting method for the injector as in claim 2, wherein the adjuster is positioned by press-fitting, and the load of the biasing member is regulated by adjusting a press-fitting degree of the adjuster.

4. The dynamic flow rate adjusting method for the injector as in claim 2, wherein the adjusting amount of the adjuster is decreased as the static flow rate of the injector increases and is increased as the static flow rate of the injector decreases in the calculating step.

5. A dynamic flow rate adjusting method for an injector, which has a valve member for opening or closing an injection hole, an electric driving member for driving the valve member to open or close and an adjuster for adjusting injection quantity of fluid injected from the injection hole by the injector, the dynamic flow rate adjusting method comprising the steps of:

measuring a flow rate of the fluid flowing through the injector;

changing an adjusting amount of the adjuster; and calculating the adjusting amount of the adjuster for achieving a target dynamic flow rate based on a static flow rate of the injector; wherein the injector has a biasing member for biasing the valve member in a direction for closing the injection hole, the electric driving member drives the valve member in a direction for opening the valve member against biasing force of the biasing member, the adjuster contacts the biasing member, the adjusting amount of the adjuster is adjusted to regulate a load, which is applied to the valve member by the biasing member in the direction for closing the injection hole, and adjusting amount of the adjuster is calculated from an adjustment coefficient in the calculating step, the adjustment coefficient being a rate of change in an ineffective injection period in a single injection command signal with respect to the adjusting amount of the adjuster.

6. The dynamic flow rate adjusting method for the injector as in claim 5, wherein adjustment coefficients of a plurality of injectors are calculated respectively and an average value of the adjustment coefficients calculated by the previous adjustment is employed as the adjustment coefficient for the present adjustment in the calculating step.

7. An apparatus for adjusting a dynamic flow rate of an injector, the injector having a valve member for opening or closing an injection hole, an electric driving member for driving the valve member to open or close and an adjuster for adjusting injection quantity of fluid injected from the injection hole by the injector, the apparatus comprising:

a flowmeter for measuring a flow rate of the fluid flowing through the injector;

a changing mechanism for changing an adjusting amount of the adjuster;

a static flowmeter for measuring the static flow rate of the injector; and a calculator for calculating the adjusting amount of the adjuster for achieving a target dynamic flow rate based on the measured static flow rate of the injector.

8. The apparatus as in claim 7, wherein the injector has a biasing member for biasing the valve member in a direction for closing the injection hole, the electric driving member drives the valve member in a direction for opening the valve member against biasing force of the biasing member, the adjuster contacts the biasing member, and the adjusting amount of the adjuster is adjusted to regulate a load, which is applied to the valve member by the biasing member in the direction for closing the injection hole.

9. The apparatus as in claim 8, wherein the adjuster is positioned by press-fitting, and the load of the biasing member is regulated by adjusting a press-fitting degree of the adjuster.

10. The apparatus as in claim 8, wherein the adjusting amount of the adjuster is decreased as the static flow rate of the injector increases and is increased as the static flow rate of the injector decreases as calculated by the calculator.

11. An apparatus for adjusting a dynamic flow rate of an injector, the injector having a valve member for opening or closing an injection hole, an electric driving member for driving the valve member to open or close and an adjuster for adjusting injection quantity of fluid injected from the injection hole by the injector, the apparatus comprising:

a flowmeter for measuring a flow rate of the fluid flowing through the injector;

a changing mechanism for changing an adjusting amount of the adjuster; and a calculator for calculating the adjusting amount of the adjuster for achieving a target dynamic flow rate based on a static flow rate of the injector; wherein the injector has a biasing member for biasing the valve member in a direction for closing the injection hole, the electric driving member drives the valve member in a direction for opening the valve member against biasing force of the biasing member, the adjuster contacts the biasing member, and the adjusting amount of the adjuster is adjusted to regulate a load, which is applied to the valve member by the biasing member in the direction for closing the injection hole; and the adjusting amount of the adjuster is calculated from an adjustment coefficient calculated by the calculator, the adjustment coefficient being a rate of change in an ineffective injection period in a single injection command signal with respect to the adjusting amount of the adjuster.

12. The apparatus injector as in claim 11, wherein adjustment coefficients of a plurality of injectors are calculated respectively and an average value of the adjustment coefficients calculated by the previous adjustment is employed as the adjustment coefficient for the present adjustment for use by the calculator.

13. A dynamic flow rate adjusting method for an injector, which has a valve member for opening or closing an injection hole, an electric driving member for driving the valve member to open or close and an adjuster for adjusting injection quantity of fluid injected from the injection hole by the injector, the dynamic flow rate adjusting method comprising the steps of:

measuring a flow rate of the fluid flowing through the injector;

changing an adjusting amount of the adjuster; and calculating the adjusting amount of the adjuster for achieving a target dynamic flow rate based on a static flow rate of the injector and an adjustment coefficient which is based on a rate of change in an ineffective injection period in a single injection command signal with respect to the adjusting amount of the adjuster.

14. The dynamic flow rate adjusting method for the injector as in claim 13, wherein adjustment coefficients of a plurality of injectors are calculated respectively and an average value of the adjustment coefficients calculated by the previous adjustment is employed as the adjustment coefficient for the present adjustment in the calculating step.

* * * * *